US007013947B1

(12) United States Patent
Stahl, Jr. et al.

(10) Patent No.: US 7,013,947 B1
(45) Date of Patent: Mar. 21, 2006

(54) METHOD FOR PREPARING ENGINE BLOCK CYLINDER BORE LINERS

(75) Inventors: Kenneth G. Stahl, Jr., St. Charles, MI (US); Barry L. Priem, Saginaw, MI (US); Allen T. Birschbach, Chesaning, MI (US); Edward C. Wall, Midland, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 11/009,374

(22) Filed: Dec. 10, 2004

(51) Int. Cl.
*B22D 19/08* (2006.01)

(52) U.S. Cl. ..... 164/103; 164/105

(58) Field of Classification Search ..... 164/98, 164/103–105
See application file for complete search history.

(56) References Cited

U.S. PATENT DOCUMENTS

| | | | | |
|---|---|---|---|---|
| 5,365,997 | A | 11/1994 | Helgesen et al. | 164/103 |
| 6,044,820 | A * | 4/2000 | Domanchuk et al. | 123/193.2 |
| 6,615,901 | B1 | 9/2003 | Kaminski et al. | 164/137 |
| 6,733,903 | B1 * | 5/2004 | Suzuki et al. | 428/624 |

* cited by examiner

*Primary Examiner*—Kuang Y. Lin
(74) *Attorney, Agent, or Firm*—Charles H. Ellerbrock

(57) ABSTRACT

A method for preparing engine block cylinder bore liners is disclosed, the method including preconditioning of the cylinder bore liners for use in sand casting of engine cylinder blocks, wherein an efficiency of the preconditioning process is maximized, a metal pour temperature is minimized, and material properties of the casting are optimized.

14 Claims, 2 Drawing Sheets

METHOD FOR PREPARING ENGINE BLOCK CYLINDER BORE LINERS

FIELD OF THE INVENTION

The invention relates to a method for preparing cylinder bore liners and more particularly to a method for preconditioning engine block cylinder bore liners for use in sand casting of engine cylinder blocks, such as engine cylinder V-blocks, with cast-in-place cylinder bore liners.

BACKGROUND OF THE INVENTION

In the manufacture of a cast iron engine V-block, a so-called integral barrel crankcase core has been used and consists of a plurality of barrels formed integrally in a crankcase region of the core. The barrels form the cylinder bores in the cast iron engine block without the need for bore liners.

In a sand casting process of an aluminum internal combustion engine cylinder V-block, an expendable mold package is assembled from a plurality of resin-bonded sand cores (also known as mold segments) that define the internal and external surfaces of the engine V-block. Typically, each of the sand cores is formed by blowing resin-coated foundry sand into a core box and curing the sand therein. Cast-in-place bore liners are often used in such castings.

Traditionally, in the manufacture of an aluminum engine V-block with cast-in-place bore liners, the mold assembly method involves positioning a base core on a suitable surface and building up or stacking separate mold elements to shape such casting features as the sides, ends, valley, water jacket, cam openings, and crankcase. The bore liners are positioned on barrel cores such that the liners become embedded in the casting after the metal is poured into the mold. Additional cores may be present as well depending on the engine design. Various designs for the barrel cores are used in the industry. These include individual barrel cores, "V" pairs of barrel cores, barrel-slab cores, and integral barrel crankcase cores. The barrel-slab and integral barrel crankcase designs are often preferred because they provide more accurate positioning of the liners within the mold assembly.

Cast iron bore liners for use in aluminum cylinder block castings are typically machined from centrifugally cast tube stock at a location remote from a foundry, where the engine block is cast. Care must be taken to prevent the machined bore liners from corroding during storage or transportation to the foundry.

The bore liners are typically machined using a cutting fluid. The cutting fluid must be removed from the bore liner prior to the casting operation. Thus, the bore liners are washed to remove the cutting fluid, and any remaining machining chips. A corrosion inhibiting coating is then applied to the bore liners. Special packaging is often used to reduce the risk of corrosion and to protect against other forms of contamination. Corrosion, residual cutting fluid, corrosion inhibiting chemicals, and skin oils associated with fingerprints all cause the formation of a detrimental gas if present on the bore liners when the molten metal is poured. This gas formation is especially evident in the practice of so-called low-pressure foundry processes such as precision sand and semi-permanent mold (SPM) processes.

One known bore liner preconditioning method for low pressure foundry processes typically includes abrasively cleaning the liners using shot blasting, for example. Abrasively cleaning the bore liners removes undesirable contaminants from the bore liner surfaces. Surface roughening caused by the abrasive cleaning also promotes intimate mechanical contact between the aluminum casting and the bore liner (layup). However, abrasive cleaning alone is not sufficient to remove some types of gas producing surface contamination, despite the clean appearance of the bore liner. The bore liners are then assembled into the mold.

A final step of heating the liners to a temperature in the range of 400 to 900 degrees Fahrenheit using an induction heating method is accomplished immediately prior to filling the mold. Heating of the bore liners immediately prior to filling the mold minimizes temperature loss in the molten aluminum as it passes over the bore liners during casting. The heating step also minimizes the risk of cold metal type casting defects and promotes good layup. Special precautions must be taken to avoid bore liner contamination between the abrasive cleaning and heating steps. Additionally, the allowable time delay between heating the bore liners to filling the mold is typically limited to less than four minutes. Delay beyond this time limit results in high risk of cold metal type casting defects.

Another known preconditioning method involves an application of a thin layer of soot or carbon black to the surface of the bore liners. This method does not require a bore liner heating step. Application of the soot layer can minimize the amount scrap caused by gas formation type defects by promoting intimate contact between the aluminum casting and the bore liner. However, the metal pouring temperature must be raised substantially to avoid cold metal type casting defects. Increased metal temperatures can cause undesirable results. The use of soot on non-heated liners also requires special design considerations for gating and other process parameters.

It would be desirable to develop a method for preparing cylinder bore liners wherein an efficiency of the preparation process is maximized, a metal pour temperature is minimized, and material properties of the casting are optimized.

SUMMARY OF THE INVENTION

Consistent and consonant with the present invention, a method for preparing cylinder bore liners wherein an efficiency of the preparation process is maximized, a metal pour temperature is minimized, and material properties of the casting are optimized, has surprisingly been discovered.

In one embodiment, the method for preparing cylinder bore liners comprises the steps of providing a cylinder bore liner; cleaning the cylinder bore liner to remove surface contaminants; baking the cylinder bore liner for a predetermined period of time at a predetermined temperature prior to assembly into a mold package; and cooling the cylinder bore liner to a predetermined cooling temperature.

In another embodiment, the method for preparing cylinder bore liners comprises the steps of providing a cylinder bore liner; cleaning the cylinder bore liner to remove surface contaminants; baking the cylinder bore liner for a predetermined period of time at a predetermined temperature; cooling the cylinder bore liner to a predetermined cooling temperature; assembling the cylinder bore liner into a mold package; and pouring a molten metal into the mold package at a predetermined metal pouring temperature.

In another embodiment, the method for preparing cylinder bore liners comprises the steps of providing a cylinder bore liner; cleaning the cylinder bore liner to remove surface contaminants using an abrasive cleaning method; baking the cylinder bore liner for at least ten minutes at at least 480 degrees Fahrenheit; cooling the cylinder bore liner to a predetermined cooling temperature; assembling the cylinder bore liner into a mold package; and pouring a molten metal into the mold package at about 1325 degrees Fahrenheit.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
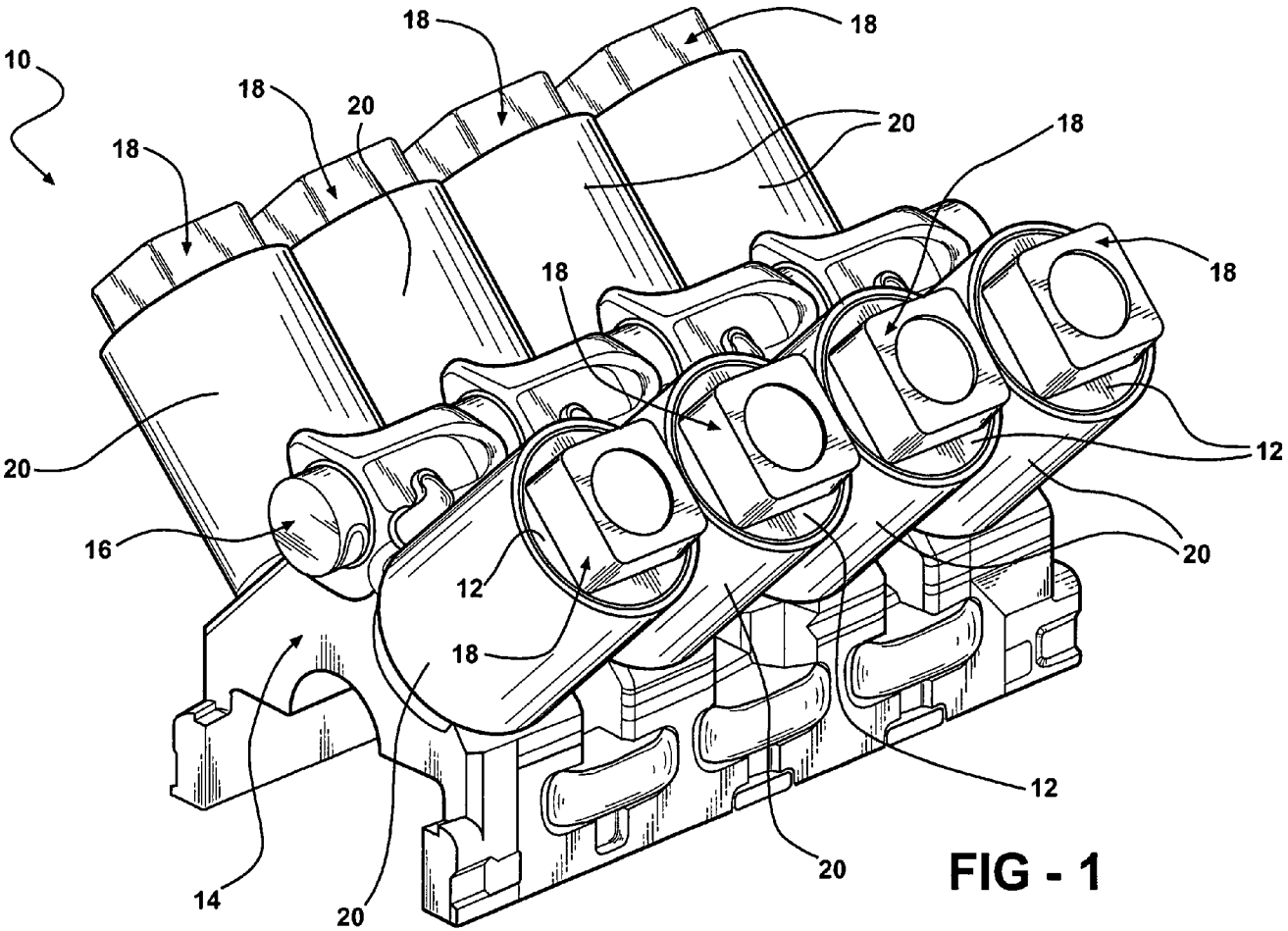
FIG. 1 is a perspective view of an integral barrel crankcase core according to an embodiment of the invention.

FIG. 1 depicts an integral barrel crankcase core 10 according to an embodiment of the invention. For purposes of illustration, and not limitation, a core for an eight-cylinder V-type engine is shown. It is understood that more or fewer cylinders can be used and that other engine cylinder configurations can be used without departing from the scope and spirit of the invention. It is also understood that the features of the invention described herein could be used with a barrel-slab core or other barrel core type. In the embodiment shown, a resin bonded sand core is used.

A mold package (not shown) is typically assembled from numerous types of resin-bonded sand cores as described in commonly owned U.S. Pat. No. 6,615,901, hereby incorporated herein by reference. The integral barrel crankcase core 10 is typically one of several cores used to assemble the mold package. The resin-bonded sand cores can be formed using conventional core-making processes such as a phenolic urethane cold box process, for example, where a mixture of foundry sand and resin binder is blown into a core box and the binder cured with a catalyst gas. The foundry sand can comprise silica, zircon, fused silica, combinations of these, and others, as desired. A catalyzed binder can comprise Isocure binder available from Ashland Chemical Company, for example.

The integral barrel crankcase core 10 includes a plurality of cylinder barrels 12 extending outwardly therefrom and terminating at a free end. In the V-type engine, the cylinder barrels 12 are disposed in two rows of cylinder barrels 12 with planes through an axis or centerline of the cylinder barrels 12 of each row. The planes of each row of the cylinder barrels 12 intersect at an angle to one another in a crankcase portion of the engine block casting (not shown). Common configurations include V6 engine blocks with 54°, 60°, 90°, and 120° of included angle between the two rows of the cylinder barrels 12 and V8 engine blocks with a 90° angle between the two rows of the cylinder barrels 12, although other configurations can be used. The cylinder barrels 12 are disposed adjacent a crankcase core region 14. In the embodiment shown, a cam shaft passage forming region 16 is integrally formed with the crankcase core region 14 on the integral barrel crankcase core 10.

Each of the cylinder barrels 12 includes a core print 18 formed thereon. The core prints 18 are shown as flat-sided polygons in shape for purposes of illustration only, as other shapes and configurations of core prints 18 can be used. Additionally, although male core prints 18 are shown, it is understood that female core prints can be used. The core prints 18 are adapted to mate with corresponding core prints formed on a jacket slab assembly (not shown).

Each of the cylinder barrels 12 has a bore liner 20 disposed thereon. The bore liners 20 form the cylinder wall for each cylinder of the engine block after the casting thereof. In the embodiment shown and described, the engine block is cast from aluminum. It is understood that other materials can be used for the bore liners 20 and the engine block as desired. The bore liners 20 are typically formed of cast iron and have a substantially circular cross section and have a hollow interior of substantially uniform diameter. The bore liners 20 can also have an axial taper on an inner surface thereof as disclosed in U.S. Pat. No. 6,615,901. An inner diameter of the bore liners 20 is typically formed to be slightly larger than an outer diameter of the cylinder barrels 12 to militate against damage or scoring of the sand forming the cylinder barrels 12 during installation of the bore liners 20. The bore liners 20 can be installed on the cylinder barrels 12 by manual or automated means.

Figure 2:
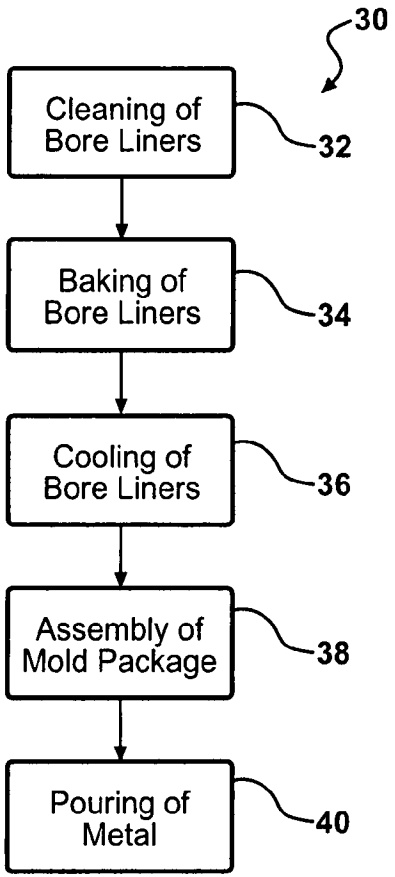
FIG. 2 is a block flow diagram illustrating a method of preparing cylinder bore liners according to an embodiment of the invention.

FIG. 2 is a block flow diagram illustrating a method 30 for preparing engine block cylinder bore liners 20 for casting, according to an embodiment of the invention. As used herein, preparing is meant to include the meanings of preconditioning, treating, inerting, and the like. Although low pressure foundry processes such as precision sand and semi-permanent mold processes are used herein for exemplary purpose, it is understood that the method can be used in other mold processes if desired.

One step in the method 30 for preparing the cylinder bore liners 20 is a cleaning step 32 to clean the cylinder bore liners 20. The cleaning step 32 can be any conventional cleaning process wherein surface contaminants are removed. Typically, the cleaning step 32 is insufficient to render the bore liners 20 inert. However, cleaning processes rendering the bore liners 20 inert can be used without departing from the scope and spirit of the invention. Inert, as used herein means removal of surface contaminants such as oils, corrosion, and debris to the point that intimate mechanical contact or adhesion between the casting and the bore liner 20 is promoted. Abrasive cleaning has been found to provide satisfactory results. Any conventional abrasive cleaning can be used such as shot blasting, for example.

Another step in the method 30 for preparing the cylinder bore liners 20 is a baking step 34, wherein the cylinder bore liners 20 are baked at a predetermined temperature for a predetermined period of time. As used herein, baking also means soaking in a heated atmosphere and the like, for example. Any conventional heating method can be used such as convective heating and inductive heating, for example. The baking step 34 is typically conducted in an oven or other similar heat source. An infrared oven can be used where it is desired to quickly bring the cylinder bore liners up to the predetermined temperature. The predetermined time is a time sufficient to render the bore liner 20 inert when baked at the predetermined temperature.

Figure 3:
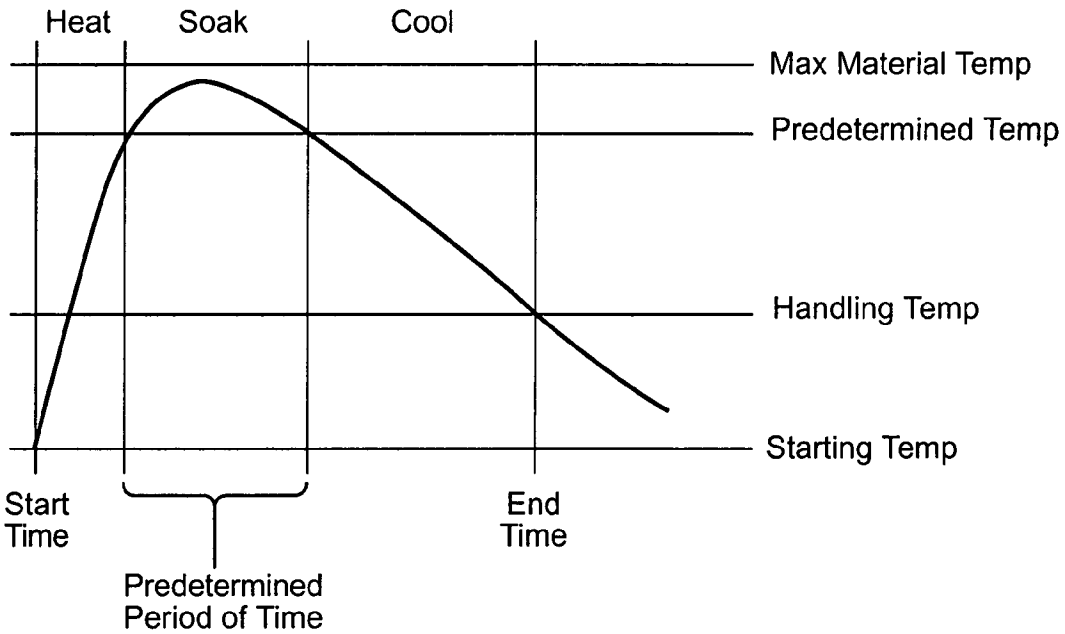
FIG. 3 is a graph showing a relationship between time and temperature parameters of the method of FIG. 2.

A graphical representation of the time and temperature relationship is shown in FIG. 3. The atmosphere surrounding the bore liners 20 is heated to the predetermined temperature, which is a function of the time of the baking step 34.

The bore liners 20 are maintained at the predetermined temperature for the predetermined period of time. The predetermined temperature and the predetermined period of time can be found experimentally. The predetermined temperature and predetermined period of time should be sufficient to pyrolize or vaporize surface contaminants. Satisfactory results have been obtained by baking the bore liners 20 at 480 degrees Fahrenheit for eight (8) hours. Similarly, satisfactory results have been obtained by baking the bore liners 20 at 750 degrees Fahrenheit for thirty (30) minutes. Using an infrared oven, satisfactory results have been obtained by baking the bore liners 20 at 750 degrees Fahrenheit for ten (10) minutes. It is understood that other temperature and time combinations can be used as desired. The predetermined temperature and predetermined period of time are dependent upon process parameters such as extent of surface contamination, a size of the bore liners 20, a spacing between the bore liners 20 during the baking step 34 if using a batch process, and other process parameters.

Another step in the method 30 for preparing the cylinder bore liners 20 is a cooling step 36. During the cooling step 36, the bore liners 20 are cooled to a predetermined cooling temperature. The predetermined cooling temperature is a handling temperature wherein it is desired to proceed with assembly of the bore liners 20 into the mold package. Satisfactory results have been found by cooling to a temperature of about 70 degrees Fahrenheit, although higher or lower temperatures can be used as desired. The cooling step 36 can be a forced cooling wherein the bore liners 20 are forced to cool faster than would occur if stored in atmospheric conditions, a slowed cooling wherein the bore liners 20 are cooled at a rate slower than would occur if stored in atmospheric conditions, or normal cooling wherein the bore liners 20 are permitted to cool in atmospheric conditions, as desired.

Once cooled, the bore liners 20 are then assembled 38 into the mold package. The metal pouring step or casting step 40 is conducted after assembly of the mold package using metal maintained at a predetermined metal pouring temperature. A metal pouring temperature of about 1325 degrees Fahrenheit has been found to provide satisfactory results, although higher or lower pouring temperatures may be used depending on other process parameters such as metal composition, casting size, and other parameters. The method 30 for preparing the cylinder bore liners 20 results in a minimization of the metal pour temperature. An unusually high metal pour temperature is not required as in the prior art methods.

Using the method 30 of the invention, an efficiency in preconditioning of the bore liners 20 is maximized. The bore liners 20 can be heated either prior to or after assembly into the mold package. If heated prior to assembly in the mold package, the bore liners 20 can be heated via a batch process, if desired, thus facilitating the heating of a large number of bore liners 20 at one time. Required heating and maintenance of temperature in the mold package as shown in the prior art is also eliminated. Dirty conditions associated with handling of carbon black or soot as used in prior art methods is avoided.

The method also allows for an optimization of material properties in the casting. A surprising result from using the method 30 is that by using the cooled bore liners 20 during the metal pouring step 40 instead of heated bore liners 20, improved metal properties result. The cooled bore liners 20 act as chills in the casting to result in a maximization of inter-bore strength due to fine grain structure and minimized microporosity. Intimate mechanical contact or adhesion between the casting and the bore liner 20 is also promoted.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A method for preparing a cylinder bore liner for use in casting of engine cylinder blocks comprising the steps of:
- providing a cylinder bore liner;
- cleaning the cylinder bore liner to remove surface contaminants;
- baking the cylinder bore liner for at least ten minutes at at least 480 degrees Fahrenheit prior to assembly into a mold package; and
- cooling the cylinder bore liner to a predetermined cooling temperature.

2. The method according to claim 1, wherein said cleaning step is an abrasive cleaning.

3. The method according to claim 1, wherein said cleaning step is a shot blasting.

4. The method according to claim 1, wherein said baking render the cylinder bore liners inert.

5. The method according to claim 1, wherein said cooling step is forced cooling.

6. The method according to claim 1, wherein said cooling step is slowed cooling.

7. A method for preparing a cylinder bore liners for use in casting of engine cylinder blocks comprising the steps of:
- providing a cylinder bore liner;
- cleaning the cylinder bore liner to remove surface contaminants;
- baking the cylinder bore liner for at least ten minutes at at least 480 degrees Fahrenheit;
- cooling the cylinder bore liner to a predetermined cooling temperature; and
- assembling the cylinder bore liner into a mold package in preparation for pouring a molten metal into the mold package at a predetermined metal pouring temperature.

8. The method according to claim 7, wherein said cleaning step is an abrasive cleaning.

9. The method according to claim 7, wherein said cleaning step is a shot blasting.

10. The method according to claim 7, wherein said baking render the cylinder bore liners inert.

11. The method according to claim 7, wherein the predetermined metal pouring temperature is at least 1325 degrees Fahrenheit.

12. A method for preparing a cylinder bore liners for use in casting of engine cylinder blocks comprising the steps of:
- providing a cylinder bore liner;
- cleaning the cylinder bore liner to remove surface contaminants using an abrasive cleaning method;
- baking the cylinder bore liner for at least ten minutes at at least 480 degrees Fahrenheit;
- cooling the cylinder bore liner to a predetermined cooling temperature; and
- assembling the cylinder bore liner into a mold package in preparation for pouring a molten metal into the mold package.

13. The method according to claim 12, wherein the abrasive cleaning method is shot blasting.

14. The method according to claim 12, wherein the predetermined cooling temperature is about 70 degrees Fahrenheit.

* * * * *